US010814523B2

(12) United States Patent
Ott et al.

(10) Patent No.: US 10,814,523 B2
(45) Date of Patent: Oct. 27, 2020

(54) MOLD FRAME HAVING DISPLACEABLE MOLD WALL, USE OF THE MOLD FRAME AS WELL AS A MOLD WALL SYSTEM HAVING A DISPLACEABLE MOLD WALL

(71) Applicant: Rampf Formen GmbH, Allmendingen (DE)

(72) Inventors: Josef Ott, Hagerstown, MD (US); Tom Griffith, Minden (CA); Andreas Wörz, Blaustein (DE)

(73) Assignee: Rampf Formen GmbH, Allmendingen (DE)

( * ) Notice: Subject to any disclaimer, the term of this patent is extended or adjusted under 35 U.S.C. 154(b) by 30 days.

(21) Appl. No.: 16/081,380

(22) PCT Filed: Mar. 1, 2017

(86) PCT No.: PCT/EP2017/000278
§ 371 (c)(1),
(2) Date: Aug. 30, 2018

(87) PCT Pub. No.: WO2017/148585
PCT Pub. Date: Sep. 8, 2017

(65) Prior Publication Data

US 2019/0070750 A1 Mar. 7, 2019

(30) Foreign Application Priority Data

Mar. 1, 2016 (DE) ..... 10 2016 002 435

(51) Int. Cl.
*B28B 7/00* (2006.01)
*B28B 7/36* (2006.01)
(Continued)

(52) U.S. Cl.
CPC ..... *B28B 7/0041* (2013.01); *B28B 7/007* (2013.01); *B28B 7/0044* (2013.01); *B28B 7/24* (2013.01);
(Continued)

(58) Field of Classification Search
CPC ..... B28B 7/0041; B28B 7/007; B28B 7/0044; B28B 7/24; B28B 7/362; B28B 7/364; B28B 7/388
See application file for complete search history.

(56) References Cited

U.S. PATENT DOCUMENTS 796,638 A 8/1905 Hall
874,366 A 12/1907 Layfield et al.
(Continued)

FOREIGN PATENT DOCUMENTS

CA 2463194 A1 10/2004
DE 143227 A1 8/1980
(Continued)

OTHER PUBLICATIONS

International Search Report and Written Opinion dated Jul. 3, 2017 in International Patent Application No. PCT/EP2017/000278, 10 pages.
(Continued)

*Primary Examiner* — Xiao S Zhao
*Assistant Examiner* — Emmanuel S Luk
(74) *Attorney, Agent, or Firm* — Shook, Hardy & Bacon L.L.P.

(57) ABSTRACT

In summary, the invention concerns a mold frame for the production of molded pieces, comprising: at least one mold cavity, the at least one mold cavity being defined by a plurality of mold walls, wherein at least one mold wall of the mold cavity is a mold wall that is displaceably attached to the mold frame.

14 Claims, 10 Drawing Sheets

(51) Int. Cl.
*B28B 7/24* (2006.01)
*B28B 7/38* (2006.01)

(52) U.S. Cl.
CPC ..... *B28B 7/362* (2013.01); *B28B 7/364* (2013.01); *B28B 7/388* (2013.01)

(56) References Cited

U.S. PATENT DOCUMENTS 1,241,487 A * 10/1917 Atterbury ..... B28B 7/0041 249/118
1,391,508 A * 9/1921 Roosa ..... B28B 7/0014 249/162
2,492,463 A * 12/1949 Carlsen ..... B28B 1/087 425/432
2,532,049 A * 11/1950 Wittke ..... B28B 7/0064 425/424
3,918,877 A * 11/1975 Pickett ..... B28B 7/0035 425/443
4,869,660 A * 9/1989 Ruckstuhl ..... B28B 7/0041 425/195
5,393,033 A * 2/1995 Wilson ..... B28B 7/0017 249/155
5,817,248 A * 10/1998 Forlini ..... B28B 7/0044 249/68
2005/0121595 A1* 6/2005 Ness ..... B28B 7/0041 249/158
2008/0315458 A1 12/2008 Ott
2009/0304842 A1* 12/2009 Ness ..... B28B 7/0041 425/150
2010/0055357 A1* 3/2010 Ciccarello ..... B28B 3/022 428/15

FOREIGN PATENT DOCUMENTS

RU 2001761 C1 10/1993
WO 2017148585 A1 9/2017

OTHER PUBLICATIONS

International Preliminary Report on Patentability dated Sep. 13, 2018 in International Patent Application No. PCT/EP2017/000278, 20 pages.

* cited by examiner

MOLD FRAME HAVING DISPLACEABLE MOLD WALL, USE OF THE MOLD FRAME AS WELL AS A MOLD WALL SYSTEM HAVING A DISPLACEABLE MOLD WALL

CROSS-REFERENCE TO RELATED APPLICATIONS AND CLAIM OF PRIORITY

This Non-Provisional Patent Application claims priority to co-pending PCT Application No. PCT/EP2017/000278, filed Mar. 1, 2017, and titled "Mold Frame Having Displaceable Mold Wall, Use of the Mold Frame as Well as a Mold Wall System Having a Displaceable Mold Wall," and German Patent Application No. 102016002435.6, filed Mar. 1, 2016, and titled "Formrahmen mit verlagerbarer Formwand, Verwendung des Formrahmens sowie ein Formwandsystem mit verlagerbarer Formwand." The contents of each of these referenced applications is incorporated herein by reference in the entirety.

TECHNICAL FIELD

The present application relates to a mold frame for producing molded pieces, in particular made of concrete, which comprise at least one side wall that is structured and/or inclined, at least in part, to the vertical.

SUMMARY

In places such as gardens, living rooms, offices, etc., it is often desired to have creative structures with artificial stones. The artificial building blocks are desired to have a natural appearance while at the same time being easy and quick to install. Structures on visible side walls of the concrete blocks may imitate a natural appearance. Furthermore, it may be desired that concrete blocks comprise horizontal or oblique recesses and/or elevations on the side walls, so that a wall can gain stability, for example by tongue and groove connection of the individual concrete blocks. For round arches, it is desired that the concrete blocks have at least one beveled side wall. In other words, at least one side wall should not be completely vertical to a bottom side of the concrete block. The present invention allows to mold concrete blocks comprising at least one side wall that is structured or uneven such as to imitate a natural shape. Alternatively or additionally, the side wall may be inclined or tilted, at least in part, to the vertical and thus be particularly suitable for curved or non-linear walls and/or round arches.

Instead of providing a multiple joint suspension, it may also be possible for a system consisting of a mold wall being fixed to the supporting wall in such a way that the mold wall can slide along an inclined plane and with the aid of a sliding roller along the supporting wall. Such a system comprises an inclined plane as a sliding plane and at least one guide roller.

As a further alternative to the levers or pivot arms described above, it may also be possible to provide a suspension system comprising oblique oblong holes with guide elements.

Conventional mold frames for the production of artificial molded pieces resp. concrete blocks comprise a grid-like mold frame having a mold space resp. a mold cavity or a plurality of mold spaces resp. mold cavities. While the mold cavities are being filled with a molding material, such as concrete, the mold frames usually rest on a bottom element resp. ground board and are filled via the upper open side of the mold cavities. After a process of compaction the molded pieces, for example by means of vibration and/or pressing, the mold frame resp. formwork frame is moved vertically upwards so that the molded pieces remain on the bottom element and may be taken out resp. moved for further processing. Alternatively, it is also possible to move resp. lower the production base resp. bottom element so that the molded pieces remain on the bottom element and can be removed or moved for further processing.

Raising the mold frame for emptying the mold cavities is not possible if at least one side wall of the concrete blocks has an uneven or structured surface and/or a non-vertical side wall with respect to the bottom element, in particular if the shape of the concrete block tapers conically downwards towards the bottom element. A structured surface of a mold wall and a corresponding molded side wall of the molded piece interlock in such a way that when the mold frame moves upwards, the molded piece jams in the mold frame and cannot slide out of the mold frame due to gravity. This similarly also applies in the case of flat side walls, which may be structured, but which are not perpendicular to the ground element. Such concrete blocks can, for example, comprise side walls that may be unstructured but have an acute angle not equal to 90 degrees to each other, as is necessary for curved blocks, for example. In other words, when seen from the side, these concrete blocks have an essentially trapezoidal projection, such as upside-down pyramid stumps or upside-down truncated cones.

Pressing pieces which compress the concrete blocks that have not yet hardened by pressing the molding material in the mold cavities are often also used for ejecting the molded pieces. In cases of undercuts and jamming of the molded pieces in the mold cavities, the molded pieces would be destroyed by the pressing pieces during ejection. In order to be able to remove the molded piece having a structured side from the mold cavity, either the mold frame must be laboriously dismantled or the mold cavity walls must be moved resp. displaced so that the mold cavities open and the molded pieces are exposed. For this reason, removing molded pieces having uneven resp. structured or non-vertical resp. vertically inclined side walls from a rigid frame by dismantling the frame is very time-consuming and unprofitable.

Horizontally moving resp. pivoting resp. displacing mold walls is already known, but has many disadvantages, as the mold frames require complicated drive units, such as motors, hydraulic cylinders and/or pneumatic cylinders.

EP 0 667 220 A1 discloses a mold for concrete blocks comprising one or more mold cavities formed by two vertical side walls and two vertical partition walls arranged parallel to each other in the longitudinal direction of the mold. For demolding molded pieces having undercuts, the partition walls can be extended horizontally in the longitudinal direction of the mold. In molds with several mold cavities, the partition walls which can be extended in the same direction are fixedly connected to each other by at least two guide rails which are longitudinally displaceable mounted in the side parts of the mold. This allows for all molded pieces to be simultaneously demolded in very short time.

In the case of mold frames having mold walls which can be displaced via hydraulics/pneumatics and/or electric actuators, the mold walls cannot build up sufficient counter pressure for filling and/or pressing in the event of a pressure drop in the hydraulic/pneumatic system or a fault in the electric actuator. For this reason, the displaceable mold walls may be pressed apart. The internal volume of the mold cavities can therefore be larger than desired. Building a wall using irregularly shaped stones is statically complicated and takes a lot of time, as it is necessary to compensate for irregularities with stones of different sizes. Molded pieces with even the slightest deviations of a few millimeters in height, width or length must therefore be disposed of. While producing molded pieces with mold frames comprising hydraulic/pneumatic mold walls, it is thus necessary to continuously measure the molded pieces and check for irregularities. Such hydraulic/pneumatic systems or electric actuators are not only expensive to purchase and maintain, but also take up a lot of space in the mold frame, so that the space that can be effectively used for mold cavities is greatly reduced.

Another drawback of horizontally displaceable mold walls is that during demolding the mold walls can grind along the bottom element and thus both the bottom element and the horizontally displaceable mold walls may be damaged or at least the contact points between the displaceable mold walls and the bottom element may wear out. Due to already cured residues of mold material such as concrete, the horizontally displaceable mold wall may even jam with the bottom element. A jammed mold wall can mean that the concrete block in question cannot be completely demolded and the entire plant must therefore be stopped. If the jammed mold wall is not immediately noticed and the concrete block molding machine is not stopped, there is even the risk of serious damage to the mold frame and other components of the concrete block molding machine. Spare parts and a repair, which can also mean a long shutdown of the concrete block molding machine, are expensive and often require expensive trained personnel.

It is an object of the present invention to provide an improved mold frame which enables to quickly and easily remove molded pieces having at least one structured side of the molded piece.

This object is solved by the subject-matter of the independent claims. Preferred embodiments are set forth in the dependent claims.

One aspect of the invention concerns a mold frame for the production of molded pieces resp. concrete blocks, comprising: at least one mold cavity, the at least one mold cavity being defined by a plurality of mold walls, wherein at least one mold wall of the mold cavity is a mold wall that is displaceable attached, in particular is pivotably attached to the mold frame resp. a support wall of the mold frame.

Preferably, the at least one mold wall may be pivotably attached to the mold frame by means of a multiple joint guide.

The mold wall is preferably arranged displaceable on the mold frame.

Preferably, the pivotable resp. displaceable mold wall may be structured and/or embossed. More preferably, the pivotable resp. displaceable mold wall may be tilted or inclined to the vertical in an operating position at least in certain areas, so that the mold cavity tapers from the upper end of the mold frame towards the lower end of the mold frame resp. towards the bottom resp. base element in the operating position.

Preferably, the pivotable mold wall in an operating position may be tilted between 0.5 degrees to 45 degrees with respect to the vertical, further preferably between 1 degree and 30 degrees, still further preferably between 2 degrees and 15 degrees and also preferably between 3 and 10 degrees. This is considering an angle between a vertical and a pivotable resp. displaceable mold wall in the operating position, wherein the vertical runs through the edge between the pivotable resp. displaceable mold wall and the bottom element and through the inner volume of the mold cavity.

In this application the vertical corresponds to the direction of a gravitational force of a body directed to the center of the earth.

The operating position refers to the position of the mold frame at which the mold frame resp. the mold walls rest on a bottom element and the mold cavities can be filled.

A mold frame having the features of the present invention inter alia is robust and not prone to mechanical and/or hydraulic/pneumatic failures, makes effective use of space, is easy to clean and enables simple assembly and disassembly. Furthermore, a mold frame having the features of the subject-matter of the present invention is insensitive to contamination and all parts may be manufactured at generous tolerances without impairing the required concrete block accuracy. These advantages are illustrated by the description of the following preferred embodiments.

An advantage of the mold frame having the features of the present invention is that the mold frame does not comprise complicated and spacious systems, such as hydraulic/pneumatic cylinders and/or electric drives. This means that a larger number of mold cavities for molded pieces may be provided, as a great deal of space is saved in the mold frame due to not having electric drives and/or hydraulically/pneumatically displaceable mold wall systems, for example. Another advantage is that the assembly and disassembly of the mold frame is very simple and quick and therefore also cost-effective and no specially trained specialists are required for assembly or disassembly. In the event of faults or damage to the mold frame, these can be quickly and easily remedied, so that the concrete block molding machine only needs to be stopped for a short time. Since the mold frame operates without hydraulics/pneumatics to open the mold cavities, disturbances caused by pressure drops or leaks in the hydraulic/pneumatics lines or cylinders are eliminated. In addition, there is no risk of the molded pieces being contaminated by escaping hydraulic fluid. Maintenance and cleaning work is quick and easy due to the small number of individual parts and the easy accessibility. In addition, additional energy consumption for a hydraulic/pneumatic system and/or electric drives is saved.

Another advantage of the mold frame having the features of the present invention is that due to the simple mechanical design of the mold frame and in particular the arrangement of the pivoting resp. displaceable mold wall it is not necessary to make changes to the machine control system and/or costly adjustments. Also, there is no increase in the process time for the production of molded pieces resp. concrete blocks.

In contrast to the above described known mold frames having hydraulically/pneumatically and/or electrically actuated displaceable mold walls, the mold frame with the features of the present invention makes advantageously better use of the production area and/or the production volume. In other words, the available space of the mold frame is used more effectively and efficiently, since the pivoting resp. displaceable mold wall requires considerably less volume than is required by, for example, hydraulic/pneumatic cylinders and/or electric motors in known mold frames.

Mold walls refer to the preferably four sides of a preferably cuboid mold cavity resp. mold space. The shape of a molded piece is substantially determined by the mold cavity, the bottom element and the pressing piece resp. piston.

The mold frame according to the invention enables in particular the molding of molded pieces resp. concrete blocks having at least one uneven resp. structured and/or embossed side wall and/or at least one side wall which is not vertical with respect to a bottom element. Mold walls refers to the preferably four sides of a preferably cuboid mold cavity. The shape of a molded piece is essentially determined by the mold cavity, the bottom element and the pressing piece resp. piston.

The mold frame preferably has a grid structure. Thus, each space between the grids may be or comprise a mold cavity, so that a mold frame can have a plurality of mold cavities. This enables the simultaneous molding of a large number of molded pieces resp. concrete blocks.

The mold frame may be displaceable in a vertical direction so that the mold frame may be lowered onto a bottom element. The mold frame and thus the at least one mold cavity resp. the plurality of mold cavities are open at the top and at the bottom. By lowering or positioning the mold frame onto the bottom element, the lower side of the mold cavity is closed and the mold cavity can be filled with mold material.

However, it may also be possible that the mold frame cannot be moved and that instead the bottom element may be moved vertically so that the bottom element can close or delimit the mold cavity or mold cavities from below. Thus, the underside of the mold cavity resp. mold cavities is formed by a section of the bottom element.

The upper side of the mold cavity is preferably delimited by a piston or pressure piece of an upper mold part that can be lowered from above. Thus, the shape of the upper mold side of a molded piece is determined by the surface shape of the piston. Traditionally, the piston can be used to exert a certain pressure on the molding material so that the desired compression is achieved. This is preferably achieved by hydraulic/pneumatic power transmission via the piston or the pressing piece and/or preferably by vibration, which can be generated, for example, by unbalance motors.

Preferably, the molded pieces are stones based on concrete or cement mixture. However, this does not exclude the possibility that the molded pieces can also be made of other materials.

Preferably the artificial stones can be produced with mineral binding, wherein preferably cement and building lime are used for binding. The molded pieces can also be made of resin-bonded materials, which can also be made of aggregates such as sand and/or broken rocks.

Such artificially produced stones are used for example for window sills, stairs, bottom coverings, wall tiles and walls. Especially in places such as ornamental gardens, living rooms, offices, fireplaces, fish ponds, cemeteries, climbing halls or swimming pools, natural aesthetics and haptics of buildings with, for example, concrete blocks are often desired. For this reason, it is preferred that molded pieces in particular have shapes that appear natural. At the same time, however, it must be possible to precisely and quickly fit the molded pieces. The present invention allows to form resp. mold for example concrete blocks having at least one structured resp. uneven side wall, which imitates a natural form of a natural stone, and/or at least one side wall, which is not vertical resp. at right angle with respect to a bottom element, for example for concrete blocks for curved wall sections.

The present mold frame is a mold frame which is used in particular in automatic concrete block molding machines. Preferably, the mold frame is made of a hard material such as steel. However, the mold frame may also be made of other metals or metal alloys.

The hardness and rigidity of the material ensures that the mold frame cannot warp or deform during operation. This prevents defective concrete blocks from being formed by warped mold frames, as well as also preventing damage to the concrete block molding machine itself. However, the mold frame may also be partly or completely made of other materials such as wood or plastic or composite materials with sufficient stiffness and load-bearing capacity.

A mold cavity is preferably formed by four mold walls, wherein at least one mold wall is structured and/or inclined to the vertical and is connected by the multiple joint guide to a supporting wall of the mold frame, so that the pivotable mold wall can be pivoted resp. displaced on an arc-shaped path, preferably with parallel alignment to the supporting wall of the mold frame. In other words, during the demolding process the mold wall can move downwards relative to the mold frame due to gravity, in the sense of a gravitational force of the mold wall directed towards the center of the earth.

The advantageous multiple joint guide is formed by preferably two levers, which are essentially vertically offset from each other resp. are arranged one below the other.

Both levers may be of equal length, so that the pivotable mold wall can be pivoted parallel to the supporting wall of the mold frame when pivoting.

However, the levers may also be of different lengths. With levers of different lengths, the mold wall pivots with a tilting movement resp. a folding movement. In other words, when the mold frame is raised from an operating position and when the mold frame is lowered onto the bottom element, the mold wall tilts resp. folds into an operating position.

Preferably the upper lever may also be longer than the lower lever. This is particularly advantageous, since during a vertical movement of the mold frame, the pivotable mold wall mounted on the support wall of the mold frame also tilts during horizontal and vertical pivoting.

Such levers are particularly suitable for the production of shaped parts with counter conicity. This means that at least one side wall of the molded piece is inclined to the vertical at least in certain areas. The side walls can be smooth or at least partially or over the entire surface, for example embossed or structured.

During filling of the mold cavity, preferably, the pivotable mold wall with its lower edge stays on the upper side of the production base resp. bottom element—as well as also the concrete block resp. the molded piece—and during form removal resp. demolding pivots away in a direction with a horizontal component. The maximum degree of movement will depend on the length of the joint elements resp. levers resp. lever arms and their maximum angle of rotation.

Preferably the pivoting is much larger than necessary due to the structure. This has the advantage that due pivoting to a larger extent the acceleration speeds of the pivoting of the mold frame are higher and thus a better cleaning effect can be achieved. Due to the longer travel distance of the mold wall during pivoting, the mold wall is accelerated more strongly. By the mold wall abruptly stopping due to the levers reaching maximum displacement or due to a stopper element capable of limiting a pivoting movement, possibly adhering mold material, for example moist concrete, is knocked off resp. shaken off from the mold wall resp. adhering mold material may detach more easily. There is thus achieved an improved cleaning result.

It is preferably avoided that the joint rod does not pivot completely vertically, i.e. that it always takes an angle of less than 90 degrees, as otherwise a return to the working area would not be ensured when the mold is lowered onto the production base.

Further preferred, the pivot angle is kept relatively small so that a maximum horizontal path of the mold wall is slightly greater than the embossing depth or counter-conicity. A longer articulated arm or lever resp. two levers of unequal length may also result in softer detachment from the stone surface when the mold wall swings away. In addition, the forces on the bearing points are reduced and, in the case of somewhat stiff bearings, there is increased the torque, which is determined by the lever lengths and the weight of the mold wall.

In this respect, it is also advantageous that the mold wall does not run too stiffly and that no excessive force is transmitted from the stone via its soft side structure to the mold wall. Furthermore, a coordinated bearing clearance is required, which withstands the concrete contamination and at the same time does not have too much joint clearance, as this clearance causes unevenness on the stone. When closed, the mold wall should only have a slight play, ideally no play in upward direction, as otherwise horizontal rearward movement may occur as soon as the angle of the joint rod deviates from the horizontal.

In the closed state resp. when the mold frame is in a lowest filling resp. operating position, the position of the levers may preferably be parallel to the bottom element, i.e. horizontal resp. perpendicular to the pivotable mold wall. From this position, the pivotable mold wall can be easily pivoted as soon as the mold frame is lifted.

It may however also be preferable that in a closed state the levers may be inclined upwards at a small angle to the horizontal. In this case, a higher vertical force is required to open the mold wall. However, the angle must not deviate too much from the horizontal, as otherwise the required stripping forces resp. demolding forces can become too great and the stone can be damaged. A small angle may be given, since the mold is usually raised very quickly and the mold wall also has a certain inertia. This of course applies only if the mold is moved instead of the production base. The angle of the levers can preferably be 1 degree upwards with respect to the horizontal. Further preferably the angle can be 3 degrees, even more preferably 5 degrees, even further preferably 10 degrees and also preferably 15 degrees. Further preferably the lever can take an angle between 0 and 30 degrees, further preferably an angle between 25 and 1 degrees, still further preferably an angle between 15 and 2 degrees and also preferably an angle between 10 and 3 degrees. In particular, an angle of 90 degrees with respect to the mold wall (back side) with a clearance of more or less than 5 degrees is preferred.

It may also be advantageous that the levers may be inclined downwards at an angle. In this case, the mold wall can easily open with a large horizontal path. However, this may be critical if due to vibrations the mold lifts slightly off the production base, as this opens at least one mold chamber resp. mold cavity and the concrete block formed in it becomes ever larger, which can lead to the other mold walls no longer being completely in contact with the production base. For this reason, one should strive for the levers to have a horizontal position during compaction. However, one may also consider the downward inclined position of the lever arms if the weight of the mold walls ensures constant contact with the bottom element.

It may also be advantageous that the lever bearings resp. pivot joints comprise at least one toggle lever. The additional lever allows to apply very high locking forces. It is possible that only the at least one upper lever or the at least one lower lever comprises or is a toggle lever. However, it is also possible that that the at least one upper lever and the at least one lower lever comprise or are toggle levers. This allows even greater closing forces to be applied. This may prevent unintended opening of the mold cavities during the compaction process.

It may also be preferable that two, three or (all) four mold walls of a mold cavity are pivotable mold walls. This may apply to all mold cavities of a mold frame, or only to at least one mold cavity or to some of the mold cavities of the mold frame. A mold frame may also comprise mold cavities with different numbers of pivotable mold walls. In other words, a mold frame may have at least one mold cavity which does not comprise any pivotable mold walls and further mold cavities which comprise at least one or more pivotable mold walls.

If the mold frame is moved resp. shifted downwards in a vertical direction, a lower edge of the pivotable mold wall comes into contact with the bottom element. Since the structured mold wall is connected to the mold frame via the multiple-joint guide, the pivotable mold wall is moved along the circular-arc path to the mold frame as the mold frame moves downwards. Due to the circular arc-shaped pivoting by means of the multiple joint guide, the pivotable mold wall is moved horizontally along the bottom element on contact with the bottom element. If all lever arms are of equal length and are arranged parallel to each other between the mold frame and the mold wall, the pivotable mold wall always pivots in orientation essentially parallel to the mold frame resp. remains vertical. If the pivot levers are all of the same length, but not arranged parallel to each other, the pivotable mold wall also pivots in its inclination.

By means of such a parallel displacement, but also if the lever arms are of different lengths, there can be established an edge contact between the at least one pivotable mold wall of a mold cavity and the bottom element, as well as between the pivotable mold wall and the adjacent mold walls. The adjacent mold walls in turn may be further pivotable mold walls. However, the adjacent mold walls may also be flat supporting walls of the mold frame.

The multiple joint guide may preferably comprise two pivot levers. In this case, the two pivoted levers may preferably be arranged vertically one above the other in relation to the bottom element. The pivoted levers are each connected to the mold frame via a pivot point. The other two ends of the lever arms are each connected to the rear of the pivotable mold wall via a pivot point.

However, the multiple joint guide may also have three, five, six, seven, eight, nine, ten, eleven, twelve or more pivot levers. In this case, at least one pivoted lever is preferably arranged offset in one plane below or above in the vertical direction of the other pivoted lever(s), in particular to enable the pivotable mold wall to pivot parallel to the mold frame.

However, it is also possible that only one pivot lever connects the pivotable mold wall with the mold frame in a way that allows parallel displacement. For example, the mold wall lining may be vertically pivotable parallel to the formwork frame by means of a lever having e.g. a rope pull system and/or a gear wheel system and/or a shaft. This has the advantage that only one contact point between the pivot lever and the pivotable mold wall or mold frame has to be loosened or fastened for disassembly or assembly. This saves time and is cost-effective because fewer fasteners such as screws have to be loosened or tightened.

It is also preferred that the pivotable mold wall may extend substantially over a length which represents at least two or more side lengths of a mold cavity, so that a pivotable mold wall delimits at least two or more mold cavities.

Therefore, a plurality of adjacent mold cavities may be defined simultaneously by a section of a pivotable mold wall.

Furthermore, two pivotable mold walls extending over several mold cavities may be positioned opposite each other. This has the advantage that the number of individual parts of the formwork system or mold frame is minimized, thus enabling quick and easy assembly and disassembly.

The pivotable mold wall may preferably be interchangeably connected to the mold frame. The mold wall can be removed and replaced by loosening the connection between the multiple joint guide and the pivotable mold wall. This means that the pivotable mold wall can be replaced by another pivotable mold wall with a different mold surface or structure, for example. This reduces costs, as only one mold frame is required to produce concrete blocks with differently shaped side walls. This makes it possible to produce a very wide range of different shaped bodies and molded pieces. In addition, the pivotable mold wall together with the multiple joint guide can be reattached to the mold frame.

The connection between the multiple joint guide and the pivotable mold wall as well as the supporting wall of the mold frame is preferably a pivot joint, which is secured by screws. This enables quick assembly and disassembly of the pivotable mold wall. However, the pivot joint connection can also be provided by a plug-in system and/or a clamping system, which enables a quickly detachable and secure connection between the pivotable mold wall and the pivot lever(s).

The possibility of quickly replacing the pivotable mold wall in just a few steps is also advantageous if a pivotable mold wall is damaged, for example. The pivotable mold wall can be dismantled in a few easy steps and replaced by a new pivotable mold wall. The quick disassembly also facilitates the repair of a damaged pivotable mold wall, as it is easier to repair the damaged pivotable mold wall when it is removed.

It is also preferred that at least the surface of the pivotable mold wall, which comes into contact with moist concrete during the production of concrete blocks, for example, is coated in such a way that the concrete cannot or can only slightly adhere to the pivotable mold wall. This prevents the still moist concrete from sticking to the pivotable mold wall and the concrete block from being damaged or deformed during demolding. Possible non-stick coatings/layers may include polymers such as Teflon® or polytetrafluoroethene or elastic rubber, which, due to preferably hydrophobic properties, prevents adhesion of the concrete, for example.

The surface of the structured surface can also be sprayed or coated with a non-stick agent such as water, oil, silicone, etc. before filling with concrete. The properties of the coating, in particular of the pivotable mold wall, may be adapted depending on the material used for the molded pieces.

The mold frame and in particular the mold walls can be heated by means of a heating element. This is advantageous with regard to undesirable adhesion of the mold material to the mold walls.

The mold cavities preferably have an essentially cuboid internal volume, with at least one mold cavity wall being structured. However, it may also be possible that the e.g. cuboid-shaped mold cavities comprise three or four pivotable resp. displaceable mold walls. Thus, essentially cuboid concrete blocks can be formed, which accordingly have two, three or four uneven resp. structured sides. The term cuboid comprises all cuboid shapes, wherein the internal angles between adjacent mold walls of a mold cavity may either be exactly 90 degrees to each other or may be larger or smaller than 90 degrees. This makes it possible to produce molded pieces that can be used for freestanding walls, for example, so that both sides of a wall show the structured form sides. Molded pieces comprising three structured sides can be used as end pieces of a freestanding wall, for example. Molded pieces with four pivotable resp. displaceable mold walls can be used for columns.

It is also possible that the mold cavities are delimited by only three mold walls, at least one mold wall being a pivotable resp. displaceable mold wall, so that the mold cavity is essentially a triangular prism having at least one pivotable resp. displaceable mold wall. It is also possible that the at least one mold cavity may also have five, six, seven, eight or more mold walls, the at least one mold cavity comprising at least one pivotable resp. displaceable mold wall. It goes without saying that a plurality or all of the mold walls can also be pivotable resp. displaceable mold walls.

Thus, it is possible to form also concrete blocks or molded pieces having three, five, six, seven, eight or more side walls, at least one vertical side of the concrete blocks being uneven or structured or having at least one undercut. Round molded pieces are advantageous e.g. for walls of curvy masonry or walls, which show a curvy course. The molded pieces can have more or less than four mold sides, depending on the curve radius of the wall, with at least one side wall being structured so that the wall also has a natural-looking structured surface in a curve area.

Further preferably a tensioning element such as a spiral spring or an elastic cord may be fitted between the pivotable mold wall and the mold frame, especially on the support wall of the mold frame to which the pivotable mold wall is attached. The tensioning element can thus pretension the pivotable mold wall. In addition to gravity, the tensioning element provides an additional force which retracts the mold wall lining parallel in the direction of the formwork frame during demolding and thus displaces the at least one pivotable mold wall on an arc-shaped path parallel to the mold frame. This prevents the formed concrete block and the at least one pivotable mold wall from remaining in a positive fit as soon as the mold frame is moved vertically upwards, thereby clamping the molded piece and lifting it upwards.

Advantageously, the upper area between the mold frame and the pivoting resp. displaceable mold wall can be covered. In a filling position, i.e. when the mold frame has been moved into a bottom position and rests on the bottom element, the upper edge of the at least one pivotable resp. displaceable mold wall can be terminated with a section of the mold frame or a cover resp. lid attached to the mold frame. While the at least one mold cavity is being filled, no concrete can penetrate into the space between the mold frame and the pivotable resp. displaceable mold wall and contaminate, for example, the multiple joint guide or the oblong hole guide element guide. This also prevents the multiple joint guide or the oblong hole guide element guide from becoming jammed or damaged by dirt.

Another aspect of the invention concerns the use of a mold frame for molding molded pieces having at least one structured side wall in accordance with one or more of the above-mentioned embodiments.

Another aspect of the invention concerns a mold wall system for retrofitting a conventional mold frame for the production of preferably parallelepiped molded pieces having at least one uneven resp. structured side wall, comprising a pivotable resp. displaceable mold wall having a structured resp. uneven mold surface; and a displacement device connecting the pivotable resp. displaceable mold wall to the mold frame in such a way that the displaceable mold wall is displaceable to the mold frame.

The displacement device may comprise or be a multiple joint guide or an oblong hole guide element guide.

The subject matter of this invention is described below with reference to a preferred embodiment.

DETAILED DESCRIPTION

Figure 1:
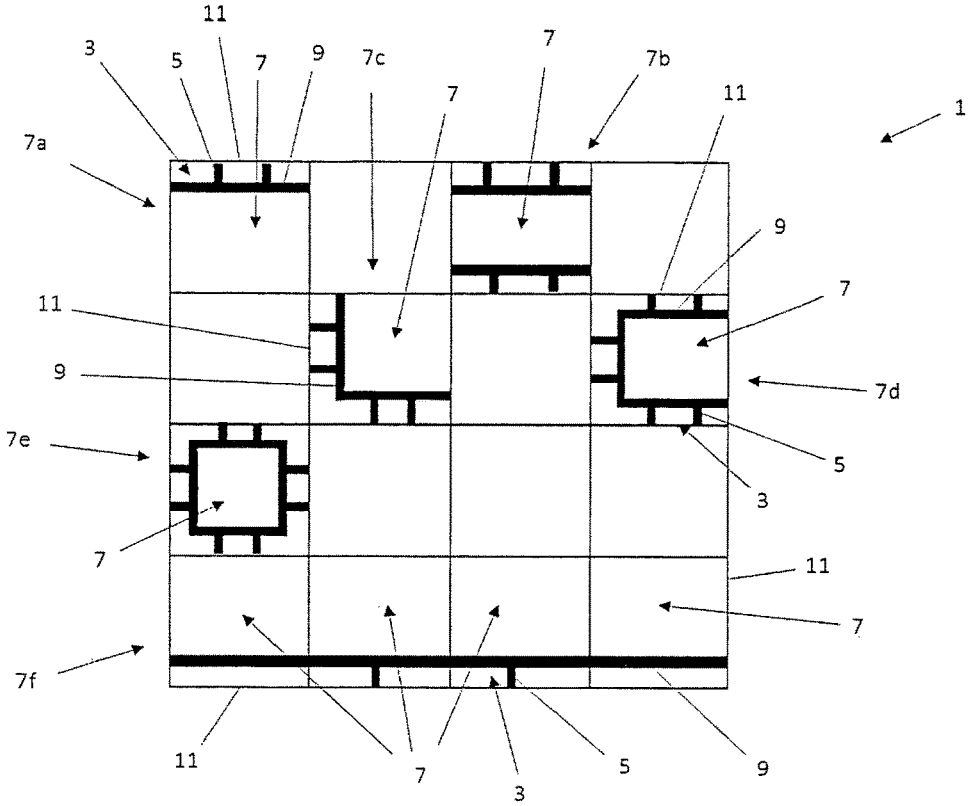
FIG. 1 shows a top view of a mold frame.

FIG. 1 is a top view of a schematically shown mold frame 1. The mold frame 1 has a grid-like structure with a plurality of grid cells. A grid cell is bounded resp. delimited by four supporting walls 11. Each grid cell can comprise a mold cavity 7 with at least one structured and/or embossed mold wall 9 and/or a mold wall 9 which is not at a right angle to a bottom element resp. is inclined from the vertical at least in certain areas resp. parts. A mold frame 1 comprises at least one mold cavity 7, the at least one mold cavity 7 comprising at least one pivotable mold wall 9. FIG. 1 shows a mold frame 1 with a plurality of mold cavities 7, wherein different exemplary configurations of individual mold cavities 7 are shown.

The mold cavity 7*a* is delimited, among other things, by three rigid and flat resp. smooth mold walls. The three mold walls correspond to three of the four supporting walls 11 of the mold frame, which form a grid cell. The fourth mold wall of mold cavity 7*a* is a pivotable mold wall which is attached to the fourth support wall 11 of mold frame 1 via a multiple joint guide 5. Together, the multiple joint guide 5 and the pivotable mold wall 9 form a mold wall system 3. A molded piece 19 (not shown in FIG. 1), which is formed resp. molded in the mold cavity 7*a*, thus has a structured resp. embossed and/or at least partially beveled side wall and three flat vertical side walls.

There is also shown a mold cavity 7*b*, which comprises two opposing pivotable mold walls 9. The two pivotable form walls 9 are each attached to two opposing support walls 11 via a multiple joint guide 5. The two further mold walls of the mold cavity 7*b* correspond to the two further support walls 11 of the mold frame 1. A molded piece 19 (not shown in FIG. 1), which is formed in a mold cavity 7 that corresponds to the mold cavity 7*b*, has two opposite structured and/or embossed and/or at least partially inclined resp. non-vertical side walls.

Mold cavity 7*c* shows a mold cavity 7 having two pivotable mold walls 9 arranged at right angles to each other. The two further mold walls correspond to the two further supporting walls 11 of mold frame 1. A molded piece 19 (not shown in FIG. 1), which is formed in the mold cavity 7*c*, has two adjacent structured and/or embossed and/or at least partially inclined resp. non-vertical side walls.

Mold cavity 7*d* shows a mold cavity 7 with three pivotable mold walls 9. The three pivotable mold walls 9 are arranged at three of the four support walls 11 via multiple joint guides 5, respectively. A molded piece 19 (not shown in FIG. 1), which is formed in the mold cavity 7*d*, has three structured and/or embossed and/or at least in some areas inclined resp. non-vertical side walls and a smooth or flat side wall.

Mold cavity 7*e* comprises four pivotable mold walls 9. Each of the four pivotable mold walls 9 is attached to a respective one of the four support walls 11 via a multiple joint guide 5. A molded piece 19 (not shown in FIG. 1), which is formed in the mold cavity 7*e*, has four structured and/or embossed and/or at least partially inclined resp. non-vertical side walls.

Mold cavities 7*f* correspond to a plurality of mold nests 7 arranged side by side, each comprising three rigid and flat resp. smooth mold walls, the rigid mold walls each being support walls 11 of the mold frame 1. The fourth mold wall of each mold cavity 7*f* is a pivotable mold wall 9, which extends over the entire length of the plurality of mold cavities 7*f* arranged next to each other. The pivotable mold wall 9 is connected via a multiple joint guide 5 to at least one support wall 11, wherein the at least one support wall 11 is a support wall 11 which is a fourth support wall of one of the grid cells comprising the mold cavities 7*f*. FIG. 1 shows an example of a pivotable mold wall 9 extending across four grid cells arranged next to each other and thus four mold cavities 7 arranged next to each other. However, a pivotable mold wall can also extend across two grid cells or mold cavities 7 arranged next to each other. A pivotable mold wall 9 can also extend across a plurality of grid cells or mold cavities 7 arranged next to one another, the plurality of grid cells or mold cavities 7 arranged next to one another being smaller than the number of mold cavities 7 or grid cells arranged next to one another of a side length of mold frame 1.

3 may be mounted on a support wall 11 if the two form wall systems 3 are in adjacent grid cells of the mold frame 1 and are mounted on one side of each support wall 11.

A mold frame 1 may also have any combination of the abovementioned configurations.

Figure 2:
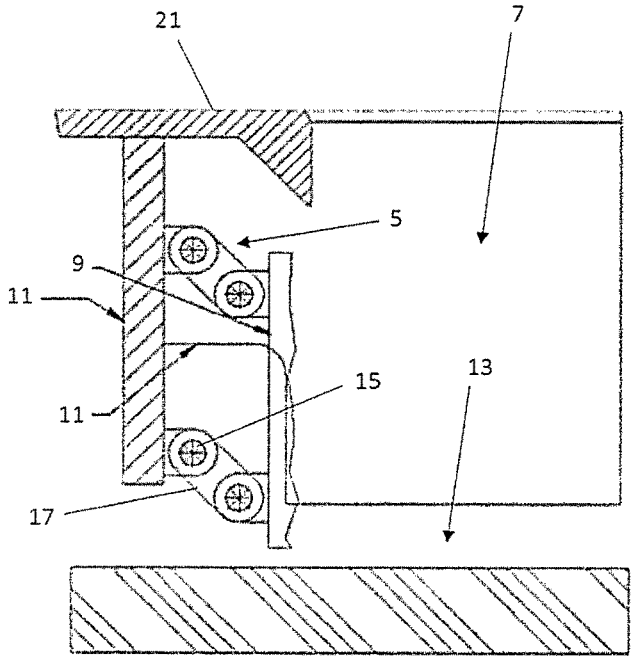
FIG. 2 shows a lateral cross-section through a section of a mold frame in a first position.

FIG. 2 is a cross-section of the side view of a section of the mold frame 1. The FIG. shows a supporting wall 11 of the mold frame 1, a bottom element 13 and a mold wall system consisting of a multiple joint guide 5 and a pivotable mold wall 9 arranged in a first upper position above the bottom element 13. The multiple joint guide 5 shown here comprises two levers resp. pivot elements resp. pivot levers 17, each connecting the pivotable mold wall 9 with the support wall 11 of mold frame 1 via pivot joints 15.

In this example, the pivot elements 17 have a same length. Therefore the multiple joint guide 5 can also be referred to as a parallelogram guide. In this specific case, the pivotable mold wall 9 is pivoted in such a way that the pivotable mold wall 9 always pivots parallel to the support wall 11. The pivotable mold wall 9 is arranged in a first lower position with respect to the support wall 11. The position of the mold frame 1 shown in FIG. 1 corresponds to the position in which a molded piece has already been demolded after a molding process. There is also shown schematically a further supporting wall 11, which is arranged essentially at a right angle to the supporting wall 11, at which the pivoting forming wall 9 is mounted.

Figure 3:
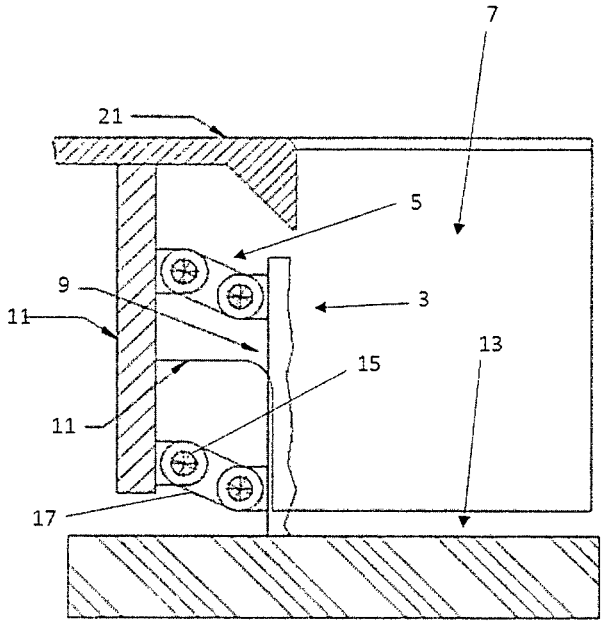
FIG. 3 shows a lateral cross-section through a section of a mold frame in a second position.

FIG. 3 shows the cross-section of FIG. 2, wherein the mold wall system 3 is moved vertically downwards to a second position, so that the lower edge of the pivotable mold wall 9 is in contact with the surface of the bottom element 13. Because the mold frame 1 has been displaced further downward in the vertical direction, the pivotable mold wall 9, when compared with FIG. 1, is partially parallel in relation to the support wall 11 in the direction of the mold cavity 7 to be formed. In other words, when compared with FIG. 2, the pivotable mold wall 9 is moved parallel to and away from the support wall 11 along the bottom element 13 by a further lowering of the mold frame. The distance between the upper edge of the pivotable mold wall 9 and a cover 21 is smaller resp. shorter than in FIG. 2.

Figure 4:
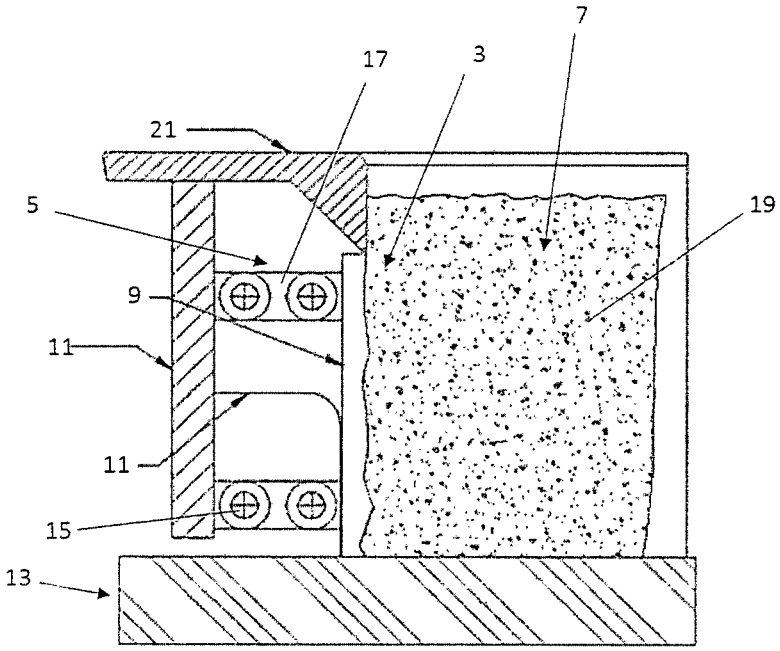
FIG. 4 shows a lateral cross-section through a section of a mold frame in a third position and a molded piece.

FIG. 4 shows the cross-section of FIG. 2 with the mold frame in a third position and the support wall 11 being in a—in vertical direction—lowest position. As a result, the pivotable mold wall 9 has the greatest possible distance to the support wall 11, the distance essentially corresponding to the length of the pivot levers 17 of the multiple joint guide 5. The upper edge of the pivotable mold wall 9 is flush with the cover 21. The lower edge of the pivotable mold wall 9 closes off with the bottom element 13. The mold space resp. cavity is filled with a molding material which forms a molded piece 19.

The support wall 11 can be designed such that when a pivotable mold wall 9 is flush with the bottom element 13, the lower edge of the support wall 11, to which a pivotable mold wall 9 is attached, either rests with the entire lower edge or over the entire lower end of the support wall 11 on the bottom element 13 or only a part of the support wall rests. It is also possible that the support wall 11 does not touch the bottom element 13.

FIG. 4 also shows that the contact area between the cover 21 and the upper edge of the pivotable mold wall 9 is as small as possible. This is solved by either the contact area of the cover 21 being formed with a pointed shape. However, it is also possible that the upper edge of the pivotable mold wall 9 is formed with a pointed shape or that both the contact area of the cover 21 and the upper edge of the pivotable mold wall 9 are formed with a pointed shape. However, the contact between the cover 21 and the upper edge of the pivotable mold wall 9 must not be too small in order to avoid excessive wear and deformation of the contact surface due to vibration and heavy loads.

Figure 5:
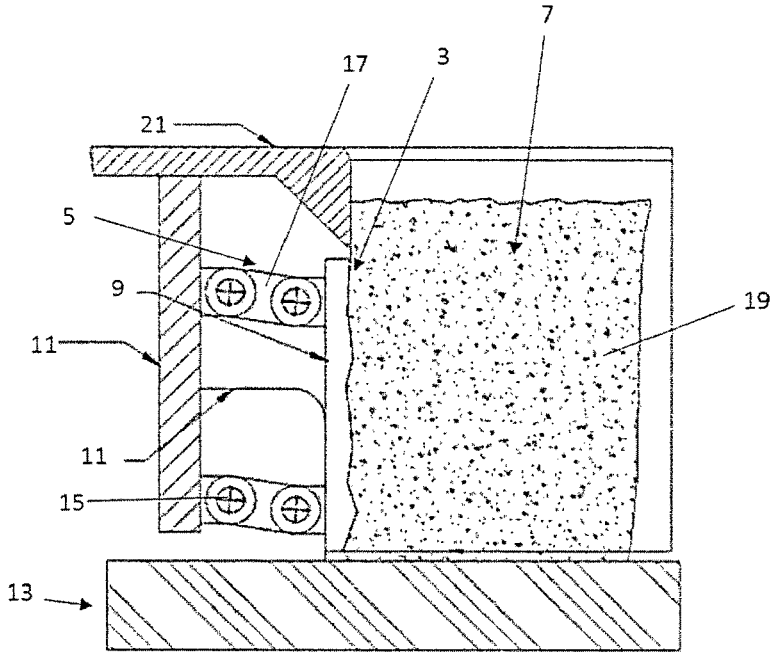
FIG. 5 shows a lateral cross-section through a section of a mold frame in a fourth position and a molded piece.

FIG. 5 shows the cross-section of FIG. 2 with the mold frame 1 being shown partly lifted upwards for demolding. By the upward movement of the mold frame 1, a flat resp. smooth side section of the cover 21 is moved vertically along the molded piece 19, whereby an upper part of the molded piece 19 is already exposed. Likewise, the supporting wall 11 is displaced upwards by the upward movement of the mold frame 1, so that a lower area of the molded piece 19 is partially exposed.

Figure 6:
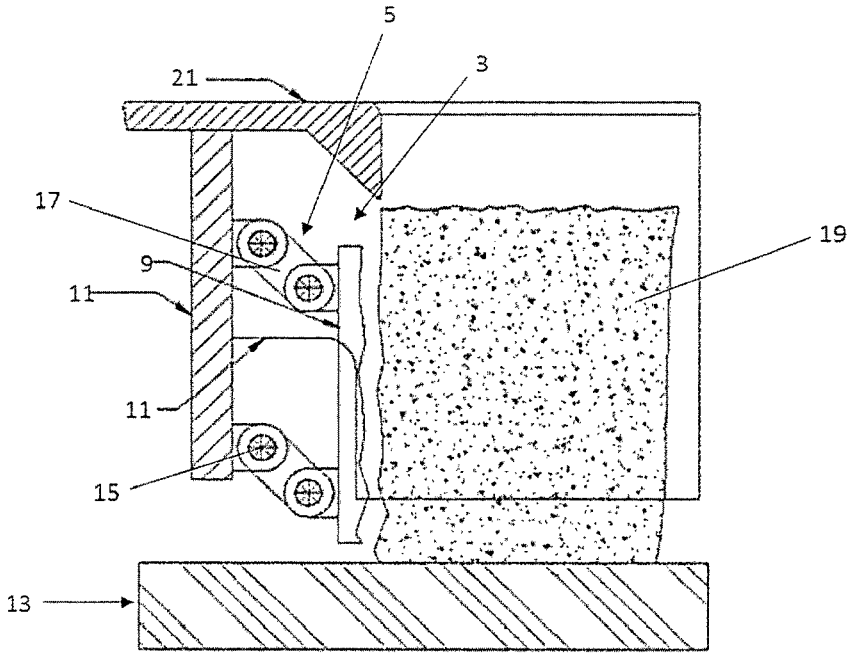
FIG. 6 shows a lateral cross-section through a section of a mold frame in a first position and a molded piece.
Figure 11:
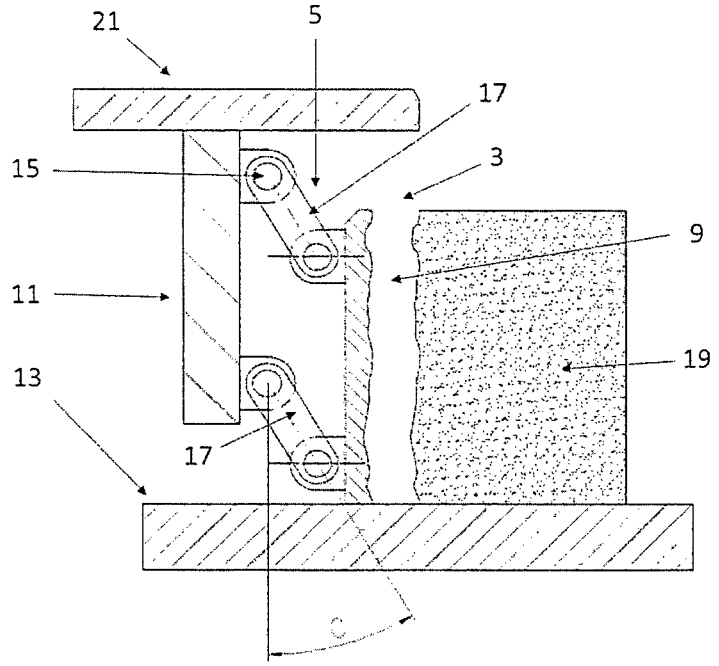
FIG. 11 shows a lateral cross-section through a section of a mold frame of FIG. 10 in a second position, the pivot levers being at an angle (C) to the support wall.

In FIG. 6, the position of the mold frame is similar to the one of FIG. 2. The support wall 1, the multiple joint guide 5 and the pivotable mold wall 9 are lifted in the first upper position. Thus, the pivotable mold wall 9 is displaced downwards parallel to the support wall 11 over an arc-shaped path. This creates the greatest possible distance between the pivotable mold wall 9 and the corresponding side wall of the molded piece 19 facing it. This allows the mold frame 1 to be safely lifted further so that the molded piece 19 can be removed resp. be transported further. Preferably, the pivotable movement of the pivotable mold wall 9 can be stopped by a stopper not shown in FIG. 6. Without such a stopper, the pivotable mold wall 9 would be resp. would rest on the production base resp. the bottom element 13. Such a stopper is also preferred, as with it an angle C (as shown in FIG. 11) does not become smaller than 0 degrees.

Figure 7:
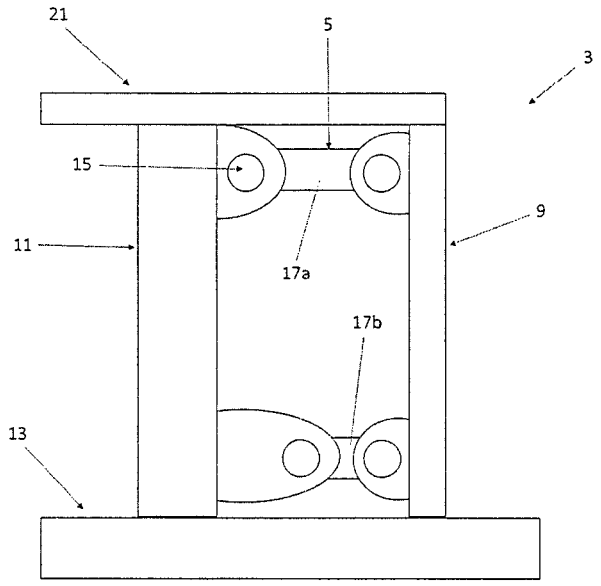
FIG. 7 shows a lateral cross-section through a section of a mold frame in a first position, the mold frame being attached to a support wall of the mold frame via an upper long pivot lever and a lower short pivot lever.

FIG. 7 shows a lateral cross-section through a section of a mold frame 1 in a first position, wherein the mold frame 1 is attached to a support wall 11 of mold frame 1 by means of an upper long pivot element 17*a* and a lower short pivot element 17*b*. The first position of the mold frame 1 corresponds to the position at which the mold cavities 7 of the mold frame 1 can be filled. In the exemplary illustration in FIG. 7, the pivoting shaped wall 9 is essentially parallel to the supporting wall 11 and with the bottom edge connects to the bottom element 13.

Figure 8:
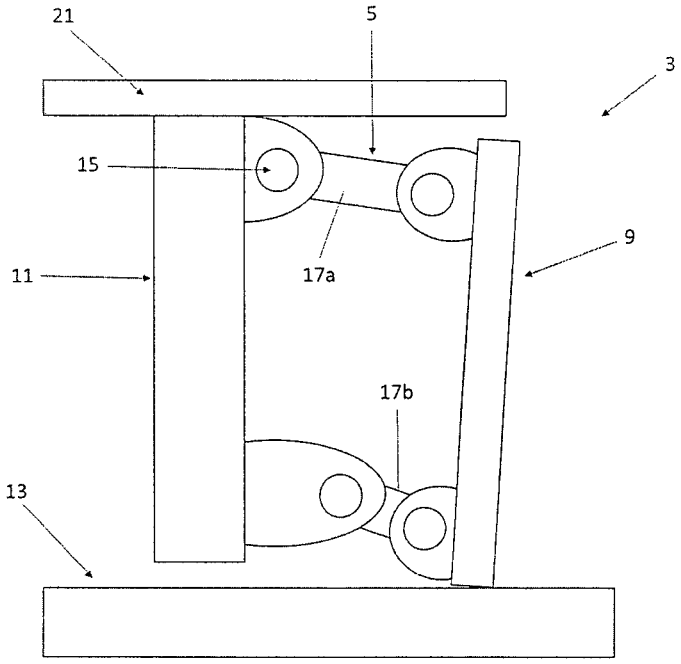
FIG. 8 shows a lateral cross-section through a section of a mold frame of FIG. 7 in a second position.

FIG. 8 shows the cross-section of FIG. 7, wherein the mold frame 1 is partially vertically displaced upwards in a second position for demolding. Due to gravity, the pivotable mold wall 9 pivots vertically downwards and pivots horizontally in the direction of the support wall 11 to which the pivotable mold wall 9 is attached. In addition, the pivotable mold wall 9 tilts relative to the support wall 11 or relative to the bottom element 13, since the pivot elements of different lengths 17*a*, 17*b* each describe circular paths of different sizes with radii corresponding to the lengths of the pivot elements 17*a*, 17*b*.

Figure 9:
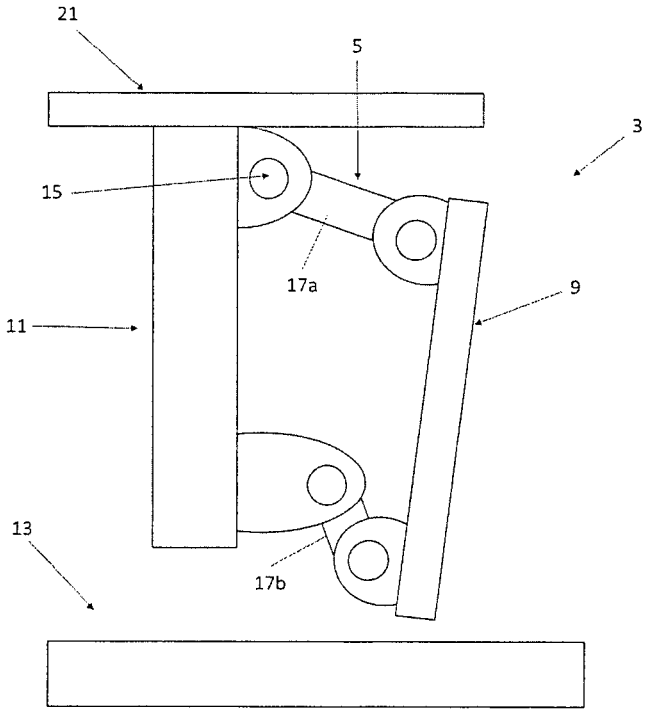
FIG. 9 shows a lateral cross-section through a section of a mold frame of FIG. 7 in a third position.

FIG. 9 shows a cross-section of FIG. 7, wherein the mold frame 1 is moved vertically to a third position above the bottom element 13, so that the pivotable mold wall 9 no longer contacts the bottom element 13. Due to the shorter lower pivot element 17*b* and the longer upper pivot element 17*a*, the pivotable mold wall 9 can be pivoted in the direction towards the multiple joint guide 5 resp. the support wall 11 and away from the mold cavity 7.

Figure 10:
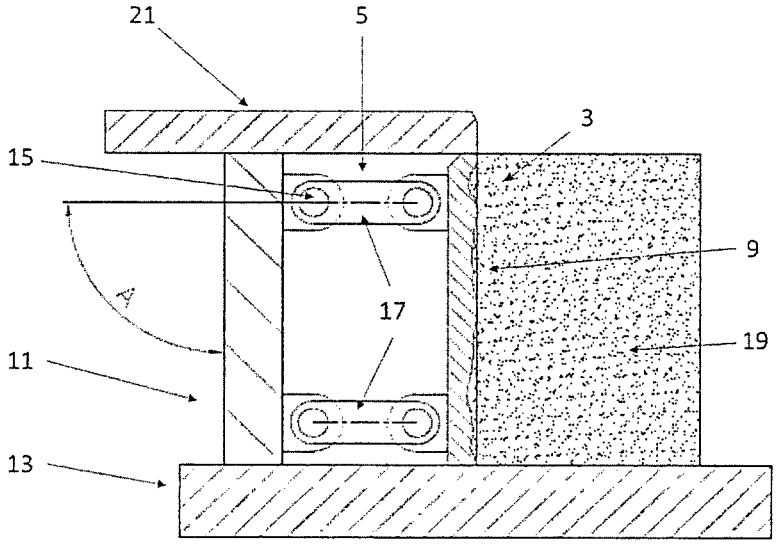
FIG. 10 shows a lateral cross-section through a section of a mold frame in an operating position resp. third position, the pivot levers being at an angle (A) to the support wall.

FIG. 10 shows a lateral cross-section through a section of a mold frame 1 in an operating position resp. third position, whereby the pivot levers 17 are arranged at an angle A to the support wall 11. In other words, the pivoted levers 17 shown in FIG. 10 are arranged at an angle of approximately 90 degrees with regard to the side of support wall 11 to which the pivoting elements 17 are attached to support wall 11. The pivot levers 17 are aligned parallel to the bottom element 13.

In an operating position of the mold frame 1 the lever arms 17 may preferably have an angle A of 90 degrees or more, but preferably at least an angle of 80 to 85 degrees, with respect to the support wall 11 to which the lever arms 17 are attached. The angle A can depend on the lengths of the lever arms 17. For example, angle A can be 80 degrees for short lever arms 17. On the other hand, it is preferred for longer lever arms 17 that the angle A is not less than 85 degrees, since as soon as the angle A is less than 90 degrees, the forming wall 9 must be moved against the forming piece 19 during demolding, which can lead to an increase in force transmission between the forming piece 19 and the forming wall 9.

FIG. 11 shows a lateral cross-section through a section of the mold frame 1 of FIG. 10, wherein the mold frame 1 is raised. Due to gravity, the mold wall 9 is pivoted downwards in relation to the mold frame resp. the mold wall 9 rests against the bottom element 13 and is additionally displaced with a horizontal component towards the support wall 11, to which the mold wall 9 is attached. This position of the mold frame 1 resp. the mold wall 9 corresponds to the position at which the molded piece 19 has essentially been demolded. The angle C shown in FIG. 11 is the angle between the orientations of the pivot lever 17, which is inclined downwards due to gravity, and the vertical. Preferably, the angle C is always greater than 0 degrees. Even more preferably, the angle C is greater than 10 degrees. This applies to vertical mold walls as well as inclined mold walls.

Figure 12:
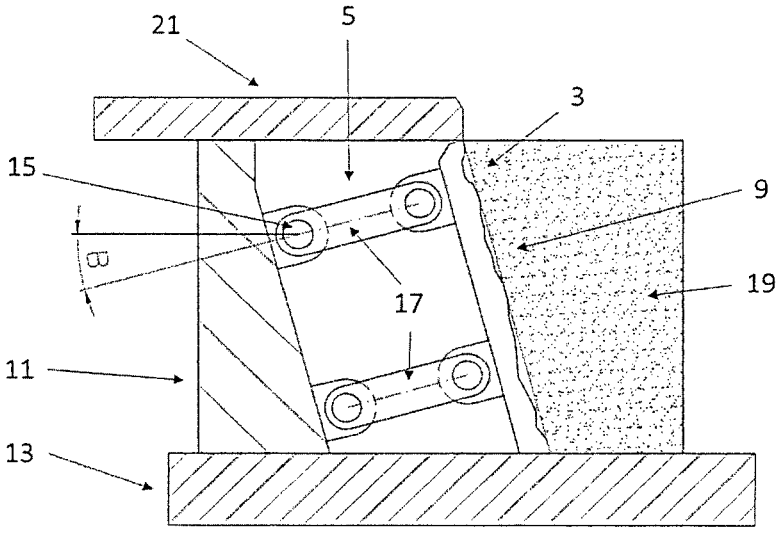
FIG. 12 shows a lateral cross-section through a section of the mold frame in an operating position, the side of the support wall to which the multiple joint guide is attached being formed conically at an angle (B)

FIG. 12 shows another exemplary embodiment of a mold frame 1 for the production of molded pieces 19 having at least one side wall. The at least one side wall is structured and/or inclined to the vertical at least in some areas. FIG. 12 shows a lateral cross-section through a section of the mold frame in an operating position. In the operating position, the side of the support wall to which the multiple joint guide 5 is attached is conical at an angle B. The pivot elements 17 are of equal length, so that the molded piece 19 runs at least the side of the molded piece 19, which is delimited by the pivotable molding wall 9, essentially at an angle from top to bottom towards the center of the molded piece 19 when viewed from the bottom element 13. In other words, the shape of the molded piece 19 tapers downwards towards the bottom element 13.

Similar to angle A from FIG. 10, the angle enclosed with the inner side of the support wall 11 is about 90 degrees. The angle B to the horizontal shown in FIG. 12 essentially corresponds to the inclination of the inner side of the support wall 11, i.e. the inclination of the pivot element 17 relative to the vertical in the earth's reference system. In the position shown in FIG. 12, the mold wall 9 moves slightly horizontally in the direction of the molded block 19 during stripping; if the angle B is too large, in extreme cases the block 19 cannot be stripped or is destroyed.

Figure 13:
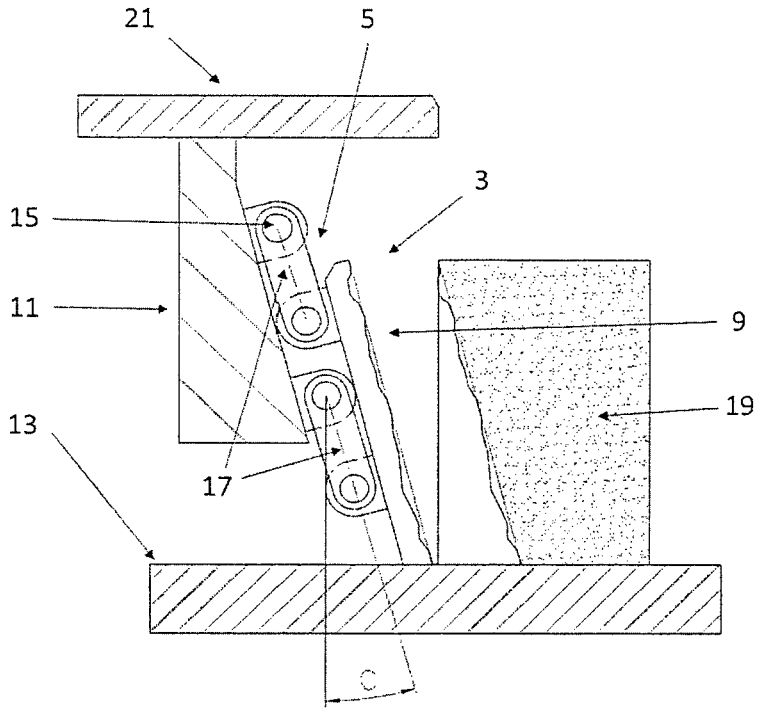
FIG. 13 shows a lateral cross-section through a section of the mold frame of FIG. 12 in a raised position.

FIG. 13 shows a lateral cross-section through a section of the mold frame of FIG. 12 in a raised position. In this position of the mold frame 1, the molded piece 19 is demolded. As shown for embodiment in FIG. 11, the angle C preferably is always greater than 0 degrees. Preferably the angle is equal to or greater than 10 degrees.

Figure 14:
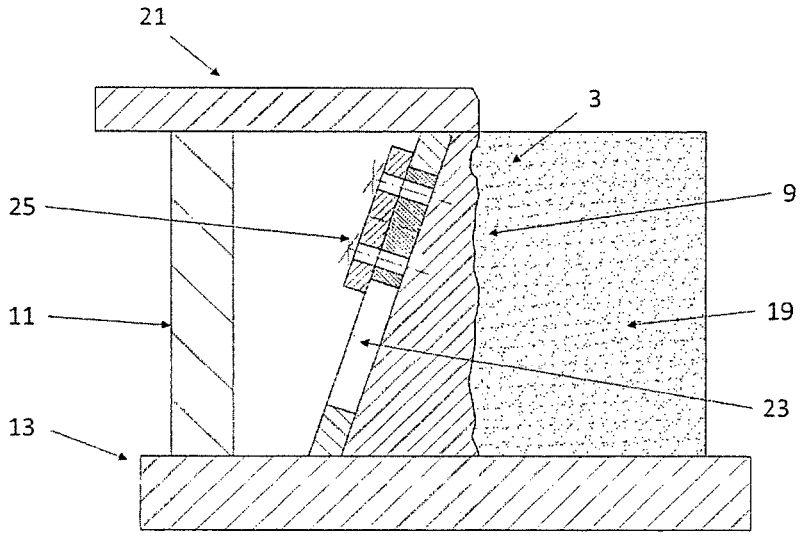
FIG. 14 shows a lateral cross-section through a section of the mold frame of a further embodiment in an operating position, a mold wall being displaceable relative to a supporting wall by means of at least one guide element and at least one oblong hole.

FIG. 14 is another exemplary embodiment of a mold frame 1 for the production of molded pieces 19 which have at least one side wall which is structured and/or at least in some areas inclined to the vertical. The exemplary embodiment shown here in FIG. 14 shows a lateral cross-section through a section of the mold frame 1 of a further embodiment in an operating position, a mold wall 9 being displaceable resp. moveable in relation to a support wall 11 by means of at least one guide element 25 and at least one oblong hole 23 resp. at least one groove 23. The support wall 11 is designed such that the mold wall 9 is connected to the support wall 11 via an oblong hole 23 resp. a groove 23 by means of a guide element 25 resp. a bolt 25. The supporting wall 11 shown is inclined upwards with respect to the vertical in the direction of the mold cavity 7. The mold wall 9 attached to the oblong hole 23 of the support wall 11 by means of bolts 25 resp. the guide element 25 is designed in such a way that the side of the mold wall 9 facing the molded piece 19 is essentially vertical.

Figure 15:
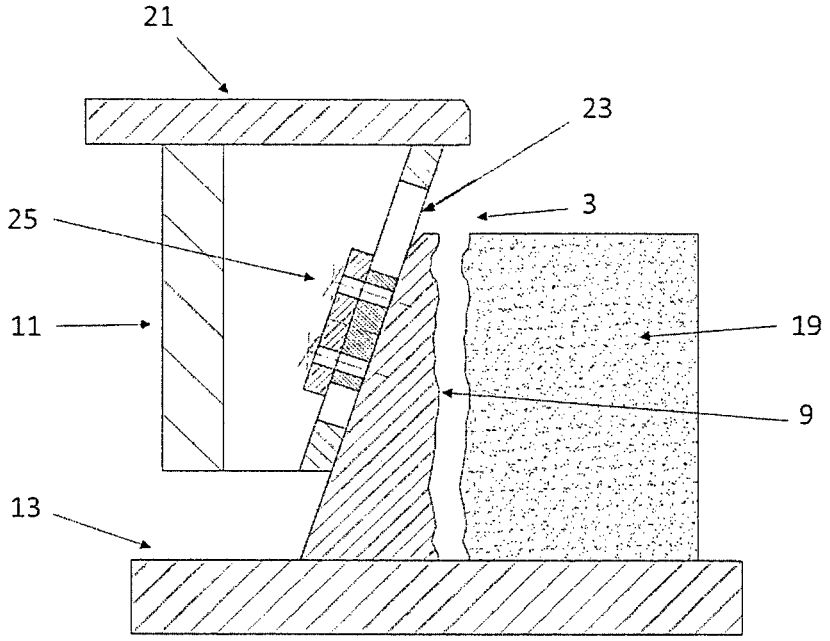
FIG. 15 shows a lateral cross-section through a section of the mold frame of FIG. 14 in a raised position.

FIG. 15 shows a lateral cross-section through a section of the molding frame of FIG. 14 in a raised position, wherein the molding 9 has been removed. Due to gravity, the mold wall is displaced downwards in the vertical direction by means of the at least one guide element 25 along the at least one oblong hole 23 and thus still rests on the bottom element 13, but is displaced in comparison to the position shown in FIG. 14 by a horizontal component in a direction away from the molded piece 19. This makes it possible to move the mold frame 1 further upwards horizontally without the mold wall 9 coming into contact with the molded piece 19 and the molded piece 19 being damaged resp. destroyed in the process.

Figure 16:
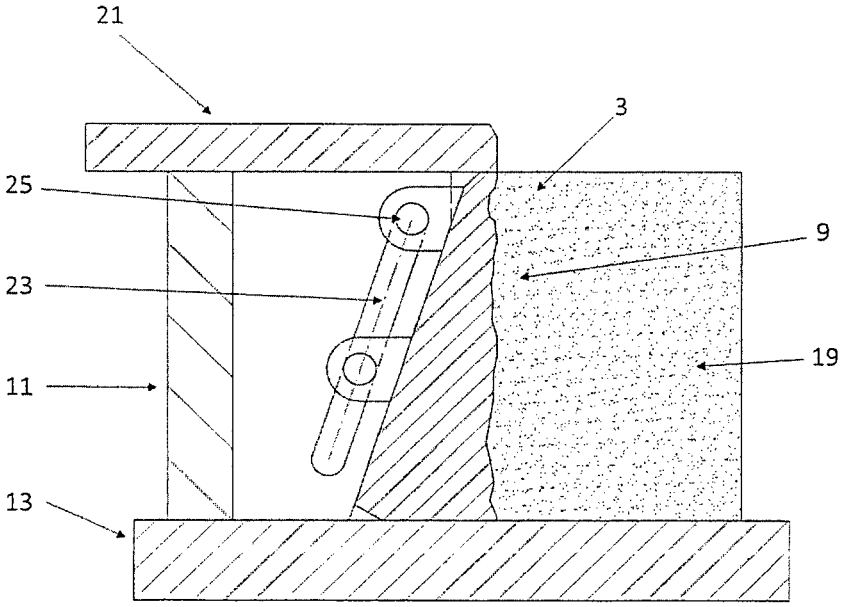
FIG. 16 shows a lateral cross-section through a section of a mold frame of a further embodiment in an operating position, a mold wall being displaceable relative to a supporting wall by means of at least one guide element and at least one oblong hole.

FIG. 16 shows a further embodiment of a mold frame 1 for the production of molded pieces 19 which have at least one side wall, the side wall being structured and/or inclined at least in some areas to the vertical. FIG. 16 shows a lateral cross-section through a section of a mold frame 1 of a further embodiment in an operating position, wherein, similar to the embodiment in FIGS. 14 and 15, a mold wall 9 can be displaced in relation to a supporting wall 11 by means of at least one guide element 25 and at least one oblong hole 23.

Figure 17:
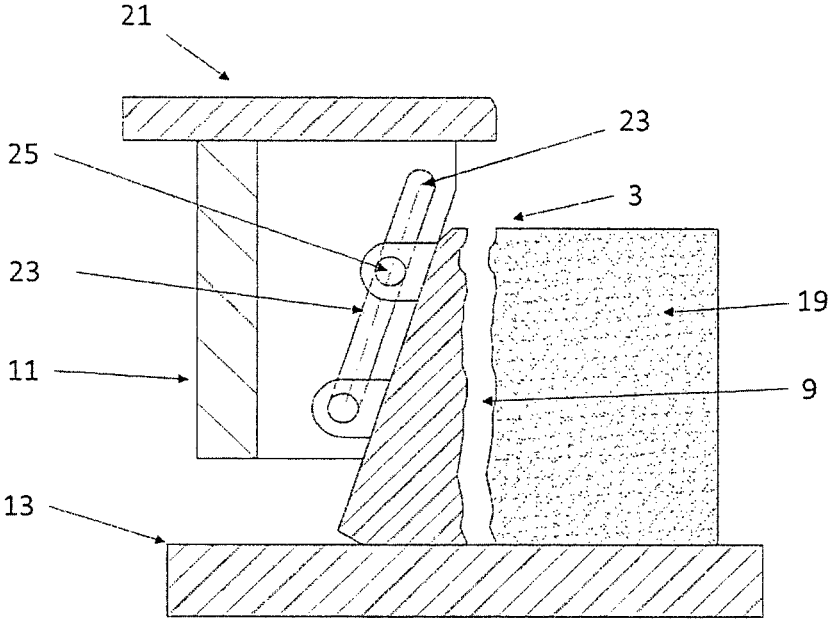
FIG. 17 shows a lateral cross-section through a section of a mold frame of FIG. 16 in a raised position.

Similar to FIG. 15, FIG. 17 shows a lateral cross-section through a section of the mold frame 1 of FIG. 16 in a raised position, where the molded piece 9 has been demolded.

With the oblong hole resp. groove variants described above, the guiding is not required to be performed within a groove 23. It is also conceivable to provide several grooves 23 into which the bolts 25 resp. the guide elements 25 engage.

In both exemplary embodiments of FIGS. 14 to 17, any angle is possible, with an angle of 45 degrees between the at least one groove 23 and the vertical being preferred. Further preferred an angle between the at least one groove 23 and the vertical is 30 degrees.

With mold walls 9 which cannot be pivoted, but are guided in grooves or oblong holes 23 (FIGS. 14 to 17), the sequence of movement is a linear function. This means that with large angles of inclination of the oblong holes 23, the mold wall 9 may open during production due to vibration forces, as the entire mold frame 1 can lift off from the bottom element 13. There is a linear dependence on the angle of inclination or inclination of the oblong holes 23 with respect to the vertical. If the mold wall 9 opens, the top of the mold wall 9 no longer closes correctly towards the bottom edge of the cover 21. With pivotable mold walls 9, the opening dimension is not a linear function, but a sine function. This means that, depending on the joint length, mold frame 1 shows a better closure during operation of the concrete block molding machine as compared to the inclined oblong holes 23, but if the inclination of the oblong holes 23 is very steep towards the vertical, the mold flap can only open slightly. However, this can have the disadvantage that with a large/deep stone profiling a high path in vertical direction and also in horizontal direction may be necessary. This is therefore not possible with low mold heights. Therefore, a combination of a vertical and an inclined or tilted guide path resp. an inclined slot 23 can be advantageous. This avoids all the disadvantages described above. In the same way, the guide path resp. the oblong hole(s) 23 could also form a circular arc track, which is equivalent to an articulated guide.

Figure 18:
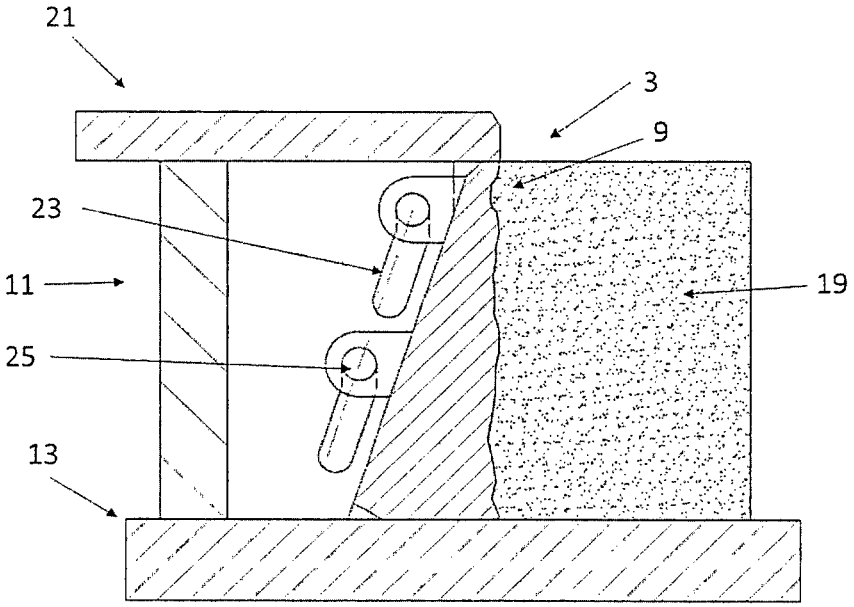
FIG. 18 shows a lateral cross-section through a section of a mold frame of a further embodiment in an operating position, the mold wall being displaceable relative to a supporting wall by means of at least one guide element and at least one oblong hole and the at least one oblong hole comprising a vertical and an inclined component.

FIG. 18 shows a lateral cross-section through a section of a mold frame 1 in an operating position resp. third position, the oblong holes 23 having a substantially vertical and an inclined component.

Figure 19:
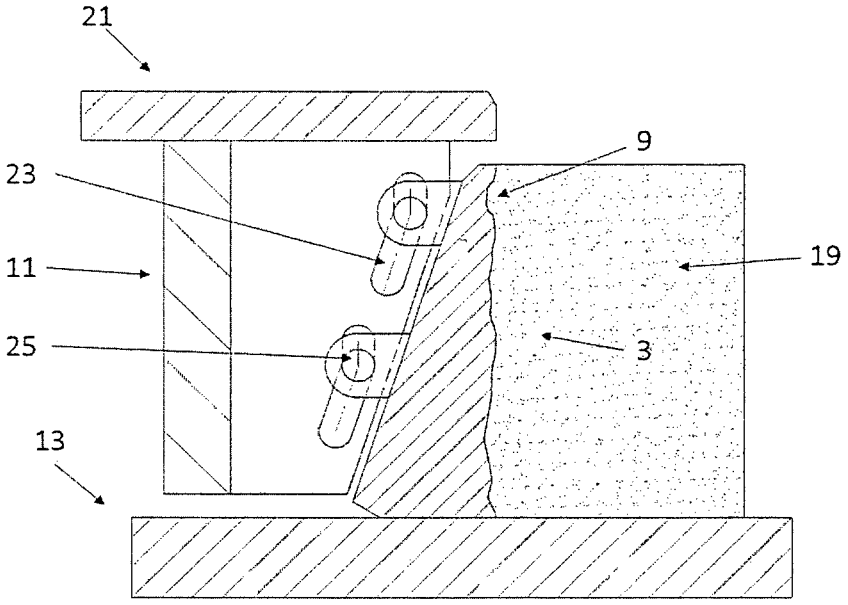
FIG. 19 shows a lateral cross-section through a section of a mold frame of FIG. 18 in a raised position.

FIG. 19 shows a lateral cross-section through a section of a mold frame 1 in a raised position, wherein similar to FIG. 18 the oblong holes 23 have a substantially vertical and an inclined component. The shown combination of a vertical and an inclined oblong hole 23 can be advantageous here, because in case of strong vibrations during operation, the mold frame 1 can lift off from the bottom element 13 due to the vibrations, but without the mold wall 9 being displaced neither in a horizontal nor in a vertical direction.

Figure 20:
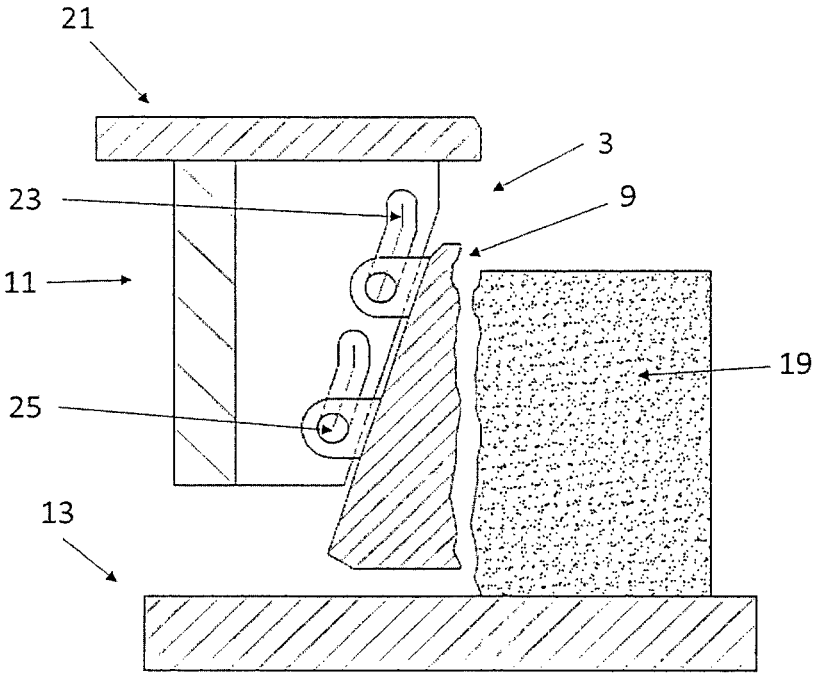
FIG. 20 shows a lateral cross-section through a section of a mold frame of FIG. 18 in a further raised position.

FIG. 20 shows a lateral cross-section through a section of a mold frame 1 in an advanced raised position. Compared to mold wall 9 of FIGS. 18 and 19, mold wall 9 is displaced by both a vertical and a horizontal distance, so that molded piece 19 is demolded.

LIST OF REFERENCE NUMERALS

1 Mold frame
3 Mold wall system
5 Multiple hinge guide
7 Mold cavity
9 Pivotable mold wall
11 Supporting wall
13 Bottom element
15 Pivot joint
17 Pivot element resp. lever
17*a* Upper pivot element resp. lever
17*b* Lower pivot element resp. lever
19 Molded piece
21 Cover
23 Oblong hole
25 Guide element

What is claimed is:

1. A mold frame for producing molded pieces, comprising:

at least one mold cavity, the at least one mold cavity being defined by a plurality of mold walls, wherein at least two mold walls of the plurality of mold walls are displaceable mold walls that are displaceably attached to the mold frame and are arranged opposite or adjacent to each other, wherein each displaceable mold wall is pivotably attached to the mold frame with a respective multiple hinge guide, and wherein each multiple hinge guide connects the respective displaceable mold wall to a respective supporting wall of the mold frame such that the respective displaceable mold wall can be pivoted while remaining substantially in parallel with the respective supporting wall.

2. The mold frame according to claim 1, wherein each multiple hinge guide comprises two pivot points that interconnect the respective displaceable mold wall with the respective supporting wall.

3. The mold frame according to claim 1, wherein each the displaceable mold wall is structured.

4. The mold frame according to claim 1, wherein each displaceable mold wall in an operating position is inclined, at least in part, relative to the vertical.

5. The mold frame according to claim 1, wherein the mold frame is displaceable in a vertical direction and the at least one mold cavity is open at the top and at the bottom, and wherein a mold bottom is formed by a portion of a bottom member when the mold frame rests on the bottom member.

6. The mold frame according to claim 1, wherein the mold frame includes a grid structure with grid gaps that form a plurality of mold cavities.

7. The mold frame according to claim 1, wherein each displaceable mold wall is replaceable.

8. The mold frame according to claim 1, wherein each displaceable mold wall is coated with a non-stick coating.

9. The mold frame according to claim 1, wherein each multiple hinge guide comprises two pivot levers that move in parallel to allow the respective displaceable mold wall to pivot while remaining substantially in parallel with the respective supporting wall.

10. The mold frame according to claim 1, wherein each multiple hinge guide comprises a shaft and/or a gear system and/or a cable pull system.

11. The mold frame according to claim 1, wherein the plurality of mold walls comprises two, three, or four displaceable mold walls.

12. The mold frame according to claim 1, wherein each displaceable mold wall is pre-tensioned substantially in the direction of the mold frame.

13. The mold frame according to claim 1, further comprising a cover that is useable to close an upper region located between each displaceable mold wall and the respective supporting wall during a process of filling the at least one mold cavity.

14. A mold frame for producing molded pieces, the mold frame comprising:

a plurality of supporting walls;

a first displaceable mold wall;

a first multiple hinge guide, wherein the first displaceable mold wall is pivotally attached to a first supporting wall of the plurality of supporting walls with the first multiple hinge guide such that the first displaceable mold wall can be pivoted while remaining substantially in parallel with the first supporting wall;

a second displaceable mold wall; and a second multiple hinge guide, wherein the second displaceable mold wall is pivotally attached to a second supporting wall of the plurality of supporting walls with the second multiple hinge guide such that the second displaceable mold wall can be pivoted while remaining substantially in parallel with the second supporting wall, wherein the first displaceable mold wall and the second displaceable mold wall are arranged opposite or adjacent to each other.

* * * * *